United States Patent [19]

Arvidsson et al.

[11] 4,450,921

[45] May 29, 1984

[54] POWER OPERATED PERCUSSION TOOL HAVING GRIPPING MEANS

[75] Inventors: Ulf K. Arvidsson, Stockholm; Per A. L. Gidlund, Täby, both of Sweden

[73] Assignee: Atlas Copco Aktiebolag, Nacka, Sweden

[21] Appl. No.: 330,086

[22] Filed: Dec. 11, 1981

[30] Foreign Application Priority Data

Dec. 18, 1980 [SE] Sweden ..... 8008915

[51] Int. Cl.[3] ..... B25D 9/00

[52] U.S. Cl. ..... 173/162 H; 173/139

[58] Field of Search ..... 173/162 H, 162 R, 139, 173/162; 30/168, 169, 277; 81/463, 464; 72/453.15, 453.16; 29/275, 276, 277

[56] References Cited

U.S. PATENT DOCUMENTS

| | | | |
|---|---|---|---|
| 1,441,117 | 1/1923 | Rowan | 30/168 X |
| 1,804,712 | 5/1931 | Stevens . | |
| 2,762,341 | 9/1956 | Salengro | 173/18 |
| 3,451,490 | 6/1969 | Troika | 30/277 X |
| 3,920,086 | 11/1975 | Goppen | 173/139 X |
| 3,937,055 | 2/1976 | Caruso et al. | 72/453.16 X |
| 3,972,218 | 8/1976 | Pawloski | 72/453.16 X |
| 4,081,038 | 3/1978 | Andersson | 173/162 |
| 4,131,165 | 12/1978 | Wanner | 173/139 X |
| 4,231,246 | 11/1980 | Gorenc | 72/453.16 X |
| 4,388,972 | 6/1983 | Gidlund | 173/162 R |

*Primary Examiner*—James M. Meister

*Attorney, Agent, or Firm*—Frishauf, Holtz, Goodman & Woodward

[57] ABSTRACT

In a hand held power operated percussion tool, the housing (10) is vibration insulated from the impact mechanism to protect the operator from unhealthy vibration forces. In order to form a vibration damped gripping member at or in front of the forward end of the tool housing (10), a sleeve element (20) is supported on the housing (10) for axial adjustability thereon. The sleeve element (20) surrounds the working implement (18) and prevents the operator from using the latter as a grip means. The sleeve element (20) is arrestable in any desired axial position by a conical lock nut (22) threadingly engaging the sleeve element (20) and forming therewith a radially acting clamp.

9 Claims, 2 Drawing Figures

13
12
14
20
22
10
18
19
17
21
15
23
16
11
24

20
22
11
10
18

POWER OPERATED PERCUSSION TOOL HAVING GRIPPING MEANS

BACKGROUND OF THE INVENTION

This invention relates to a power operated percussion tool of the type having grip means for manual support and guidance of the tool. In particular, the invention concerns a percussion tool in which an impact mechanism is vibration insulated from the housing and comprises means for connection of a working implement. The invention may find its application on rivet hammers, chisel hammers etc.

In power tools of the above type the operator supports the tool by grasping with his one hand the rear end of the tool housing, for instance a handle thereon, and with his other hand the forward end of the tool, usually the working implement. A problem concerning this type of machine support is that unhealthy vibrations are transferred to the operator's hand when grasping the working implement.

The present invention intends to solve the above problem by suggesting a grip means which enables a steady two-hand support of a tool of this type without exposing the operator to unhealthy vibration forces. Specific features and advantages of the invention will be apparent from the following detailed description and the claims. A preferred embodiment of the invention is hereinafter described in detail with reference to the drawing.

DETAILED DESCRIPTION

Figure 1:
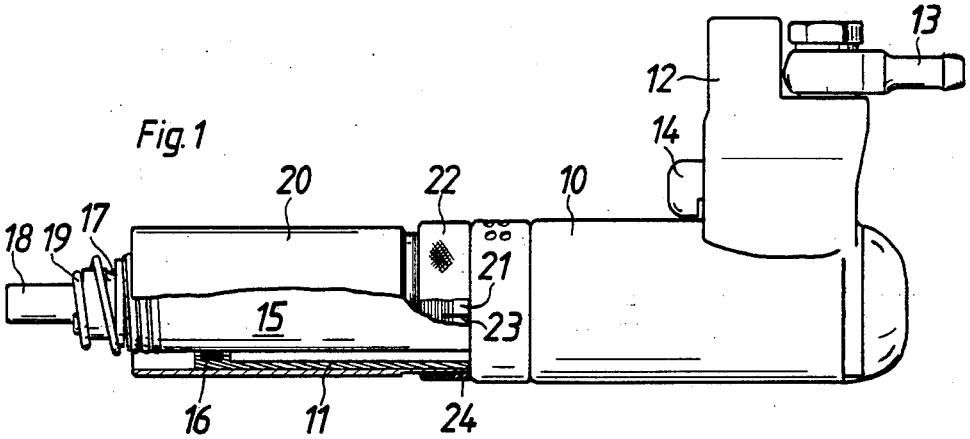
FIG. 1 shows a partly broken side-view of a percussion tool according to the invention.

The power tool shown in the drawing figures comprises a housing 10 formed with a tubular forward end portion 11 and provided at its rear end with a handle 12 on which is mounted a hose nipple 13 for connection of a pressure air conduit. Within the handle 12, there is mounted a throttle valve (not shown) controlled by a trigger 14.

Within the housing 10 there is mounted a pneumatic piston-cylinder type impact mechanism 15. The latter is guided in the housing 10 for a limited axial reciprocating movement. A vibration absorbing means (not shown), for instance a pressure air volume, is employed to axially support the impact mechanism 15 in the housing 10. A typical vibration absorbing means is shown, for example, in U.S. Pat. No. 1,804,712 which discloses a pneumatic hammer comprising an air cushion vibration absorbing means. At its forward end, the impact mechanism 15 is guidingly supported by an annular bearing element 16 which is mounted in the forward end portion 11 of the housing 10 and provided with a tool receiving opening 17 through which is inserted a working implement 18. A tool retaining spring 19 is provided for keeping the working implement 18 in a proper position.

On the tubular forward end portion 11 of the housing 10 there is supported an axially adjustable sleeve element 20. The latter is intended to form a grip means by which the operator is able to support the forward end of the tool. By the axial adjustability of the sleeve element 20 it is possible to adapt the location of the grip to the actual type of working implement attached to the tool. The longer the working implement is, the more forward the sleeve element 20 is extended. The sleeve element 20 is arrestable relative to the housing portion 18 by means of a clamping means. The latter comprises a conical portion 21 at the rear end of the sleeve element 20 and a clamp nut 22 formed with a corresponding conical inner portion 24. The clamp nut 22 threadingly engages the sleeve element 20 to form therewith the radially acting clamping means. To facilitate radial compression of the conical end portion 21 of the sleeve 20, the latter may be provided with a number of longitudinal slots 23. Preferably, the sleeve 20 is made of a suitable plastic material which is easily compressible without the sleeve 20 being provided with slots 23.

As mentioned above the sleeve 20 is axially displaceable along the front portion 11 of the housing 10 in order to adapt the grip point to the length of the actual working implement. In FIG. 1, the sleeve 20 is illustrated in its rearmost position. Though extending beyond the forward extremity of the housing portion 11, the sleeve element 20 provides access to the retaining spring 19 for releasing the working implement 18.

Figure 2:
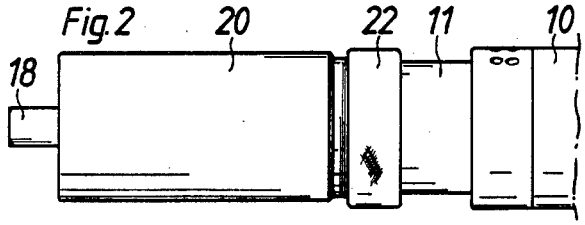
FIG. 2 shows the front part of the tool in FIG. 1 with the forward grip means in an extended position.

In FIG. 2, the sleeve element is shown in an extended working position. In this position, the sleeve element 20 may be arrested by means of the nut 22 to prevent unintentional displacement relative to the housing 10. Since the arresting means comprises the even cylindrical surface of the front portion 11 and a selectively compressible clamping means on the sleeve element 20, the latter is arrestable in any desired position along the front portion 11 of the housing 10. This arrangement makes it possible for the operator not only to find and arrest the sleeve element 20 in any suitable position but to arrange the sleeve 20 heavily slidable along the housing portion 11. This is accomplished by a light tightening only of the clamp nut 22 such that a desired friction force between the sleeve element 20 and the housing portion 11 is obtained. In some applications where a frequent adjustment of the sleeve element 20 is necessary it is most advantageous to be able to make such adjustments without having to loosen and retighten the lock nut 22 every time.

The operator just has to pull the sleeve element in either direction to overcome the friction grip which during normal use of the tool is strong enough to arrest the sleeve element 20 and prevent unintentional displacement thereof.

A significant feature of the device according to the invention is that, although forming a grip means at the front end of or even ahead of the impact mechanism, the sleeve element 20 is supported entirely on the vibration protected housing 10. This assures the operator a safe and comfortable grip means.

The embodiments of the invention are not limited to the above described example but can be freely varied within the scope of the invention as it is defined in the claims. For example, the arresting means for preventing unintentional displacement of the sleeve element 20 could be formed by a radial pretensioning of the latter such that a suitable constant friction grip relative to the housing portion 11 is established. Instead of pretensioning the sleeve element 20 itself a suitable friction force may be obtained by providing the sleeve element 20 with a piece of resilient material, for instance an O-ring. The sleeve element 20 is preferably made of a plastic material such as an impact resistant composite of polyamide 6.6 and polyethylene.

We claim:

1. A vibration damped power operated percussion tool, comprising in combination:

an impact mechanism;

means on said impact mechanism for operative connection of a working implement thereto;

a housing supporting said impact mechanism and being vibration insulated relative to said impact mechanism, said vibration insulated housing having a portion extending in given axial direction, and a forward end beyond which said working implement extends;

a handle at the rear end of said housing for manual support of the tool by an operator;

a sleeve element extending in said axial direction and being adjustably mounted around at least a portion of said axially extending portion of said vibration insulated housing so as to be adjustable in position relative to said housing in said axial direction;

said sleeve element, in use of said tool, extending beyond the forward end of said housing, thereby forming an advanced vibration insulated grip means which is grippable by the tool operator during use of the tool; and arresting means coupled to said sleeve element for arresting movement of said sleeve element relative to said housing for preventing unintentional axial displacement of said sleeve element relative to said housing, said arresting means comprising a friction coupling for frictionally engaging said sleeve element to said housing, and a clamping device operatively coupled to said sleeve element for continuously varying the engagement force of said friction coupling.

2. The percussion tool of claim 1, wherein said sleeve element is cylindrical; and said arresting means comprises a clamping nut threadingly engaging said sleeve element to form therewith said clamping device.

3. The percussion tool of claim 2, wherein the portion of said sleeve element is generally conical in shape; and wherein said clamping nut has a generally conical shape in the portion thereof which engages said sleeve element.

4. The percussion tool of claim 3, wherein said sleeve element has axially directed slits therein in the portion thereof engaged by said clamping nut.

5. The percussion tool of claim 2, wherein said sleeve element has axially directed slits therein in the portion thereof engaged by said clamping nut.

6. The percussion tool of claim 1, wherein said sleeve element is slidably mounted on said housing for telescopic movement thereon between arbitrarily chosen positions.

7. The percussion tool of claim 1, wherein said sleeve element is made of an impact resistant material.

8. The percussion tool of claim 7, wherein said impact resistant material is a plastic material.

9. The percussion tool of claim 8, wherein said plastic material is a composite of polyamide 6.6 and polyethylene.

* * * * *